US010733933B2

(12) United States Patent
Gao

(10) Patent No.: US 10,733,933 B2
(45) Date of Patent: Aug. 4, 2020

(54) PIXEL DRIVING CIRCUIT AND DRIVING METHOD THEREOF, DISPLAY PANEL AND DISPLAY DEVICE

(71) Applicant: BOE Technology Group Co., Ltd., Beijing (CN)

(72) Inventor: Xueling Gao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/146,420

(22) Filed: Sep. 28, 2018

(65) Prior Publication Data

US 2019/0103055 A1 Apr. 4, 2019

(30) Foreign Application Priority Data

Sep. 29, 2017 (CN) ..... 2017 1 0909301

(51) Int. Cl.
*G09G 3/32* (2016.01)
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/043* (2013.01); *G09G 2300/0426* (2013.01); *G09G 2300/0809* (2013.01); *G09G 2300/0819* (2013.01); *G09G 2300/0842* (2013.01); *G09G 2300/0861* (2013.01); *G09G 2320/0233* (2013.01); *G09G 2320/0257* (2013.01); *G09G 2320/043* (2013.01); *G09G 2320/045* (2013.01)

(58) Field of Classification Search
None
See application file for complete search history.

(56) References Cited

U.S. PATENT DOCUMENTS

2017/0132975 A1* 5/2017 Park ..... G09G 3/3233
2019/0096334 A1* 3/2019 Li ..... G09G 3/3233

* cited by examiner

*Primary Examiner* — Joseph R Haley
(74) *Attorney, Agent, or Firm* — Westman, Champlin & Koehler, P.A.

(57) ABSTRACT

Embodiments of the present disclosure provide a pixel driving circuit configured to drive a light emitting element to emit light. The pixel driving circuit may comprise a driving sub-circuit, coupled to the light emitting element; a data writing sub-circuit, coupled to the driving sub-circuit and configured to receive a scanning signal, a reference voltage signal, and a data signal, and supply the reference voltage signal and the data signal to the driving sub-circuit successively under a control of the scanning signal; and a light emitting controlling sub-circuit, coupled to the data writing sub-circuit and the driving sub-circuit, and configured to receive a first controlling signal and a second controlling signal, and to control the driving sub-circuit to drive the light emitting element to emit light under a control of the first controlling signal and the second controlling signal.

12 Claims, 10 Drawing Sheets

PIXEL DRIVING CIRCUIT AND DRIVING METHOD THEREOF, DISPLAY PANEL AND DISPLAY DEVICE

CROSS-REFERENCE TO RELATED APPLICATION(S)

This application claims a priority of Chinese Patent Application No. 201710909301.X filed on Sep. 29, 2017, the disclosure of which is incorporated herein by reference in its entirety as part of this application.

TECHNICAL FIELD

The present disclosure relates to a field of display technology, and in particular, to a pixel driving circuit and a driving method thereof, a display panel and a display device.

BACKGROUND

Organic light emitting diode (OLED) displays are one of hotspots in a field of flat panel display.

Unlike thin film transistor-liquid crystal displays (TFT-LCD) which uses a stable voltage to control brightness, the OLEDs displays are current driven elements and require a stable current to control brightness. The pixel driving circuit of the OLED display comprises a driving tube. When the row in which a pixel unit is positioned is gated, a switching transistor connected to a driving transistor is turned on. Thus, the data voltage is applied to the driving transistor via the switching transistor, enabling the driving transistor to output a current corresponding to the data voltage to the OLED display. Accordingly, the OLED display emits light having a corresponding intensity.

SUMMARY

According to an aspect of embodiments of the present disclosure, there is provided a pixel driving circuit, configured to drive a light emitting element to emit light, the pixel driving circuit comprising: a driving sub-circuit, coupled to the light emitting element; a data writing sub-circuit, coupled to the driving sub-circuit and configured to receive a scanning signal, a reference voltage signal, and a data signal, and supply the reference voltage signal and the data signal to the driving sub-circuit successively under a control of the scanning signal; and a light emitting controlling sub-circuit, coupled to the data writing sub-circuit and the driving sub-circuit, and configured to receive a first controlling signal and a second controlling signal, and to control the driving sub-circuit to drive the light emitting element to emit light under a control of the first controlling signal and the second controlling signal.

For example, the light emitting controlling sub-circuit may comprise a first light emitting controlling sub-circuit and a second light emitting controlling sub-circuit, wherein the first light emitting controlling sub-circuit is coupled to the driving sub-circuit, the data writing sub-circuit and the second light emitting controlling sub-circuit, and the second light emitting controlling sub-circuit is coupled to the data writing sub-circuit and the driving sub-circuit.

For another example, the first light emitting controlling sub-circuit may comprise a first transistor, the second light emitting controlling sub-circuit may comprise a second transistor, and the driving sub-circuit may comprise a driving transistor, wherein:

the first transistor has a controlling electrode to receive the first controlling signal, a first electrode to receive a first power supply signal, and a second electrode coupled to a drain of the driving transistor;

the second transistor has a controlling electrode to receive the second controlling signal, a first electrode coupled to the first light emitting controlling sub-circuit, and a second electrode coupled to a gate of the driving transistor; and the driving transistor has a source coupled to a first electrode of the light emitting element.

For another example, the data writing sub-circuit may comprise a third transistor, a fourth transistor, and a storage capacitor, wherein:

the third transistor has a controlling electrode to receive the scanning signal, a first electrode coupled to a first electrode of the storage capacitor and the first electrode of the second transistor, and a second electrode coupled to the source of the driving transistor;

the fourth transistor has a controlling electrode to receive the scanning signal, a first electrode to receive the reference voltage signal and the data signal successively, and a second electrode coupled to the gate of the driving transistor; and the storage capacitor has a second electrode coupled to the drain of the driving transistor.

For another example, the first light emitting sub-circuit may further comprise a fifth transistor, wherein: the fifth transistor has a controlling electrode configured to receive the first controlling signal and a first electrode coupled to the first electrode of the second transistor.

For another example, the data writing sub-circuit may comprise a third transistor, a fourth transistor, and a storage capacitor, wherein:

the third transistor has a controlling electrode to receive the scanning signal, a first electrode coupled to a first electrode of the storage capacitor and the first electrode of the second transistor, and a second electrode coupled to the source of the driving transistor;

the fourth transistor has a controlling electrode to receive the scanning signal, a first electrode to receive the reference voltage signal and the data signal successively, and a second electrode coupled to the gate of the driving transistor; and the storage capacitor has a second electrode coupled to the drain of the driving transistor.

For another example, the driving transistor and the first to fourth transistors may be low temperature polysilicon transistors.

For another example, the first to fourth transistors may be P-type transistors.

For another example, the first to fourth transistors may be N-type transistors.

For another example, the driving transistor and the first to fifth transistors may be low temperature polysilicon transistors.

For another example, the first to fourth transistors may be P-type transistors.

For another example, the first to fourth transistors may be N-type transistors.

According to another aspect of the present disclosure, there is provided a method for driving the pixel driving circuit in accordance with the embodiments of the present disclosure, the method comprising:

supplying the reference voltage signal to the driving sub-circuit under the control of the scanning signal and the first controlling signal, during an initialization phase;

supplying the data signal, a threshold voltage of the driving transistor and a threshold voltage of the light emitting element to the driving sub-circuit, under the control of the scanning signal, during a compensation phase; and driving, by the drive sub-circuit, the light emitting element to emit light under the control of the first controlling signal and the second controlling signal, during a light emitting phase.

For example, the method according to the embodiments of the present disclosure may further comprise:

supplying the data signal, the threshold voltage of the driving transistor, and the threshold voltage of the light emitting element to the driving sub-circuit under the control of the scanning signal and the second controlling signal, during a pre-light emitting phase prior to the light emitting phase but after the compensation phase.

For another example, the reference voltage signal may have an amplitude greater than that of the data signal.

For another example, during the initialization phase, the scanning signal and the first controlling signal may be at a first level, the second controlling signal may be at a second level, and the reference voltage signal may be supplied to the driving sub-circuit; wherein:

during the compensation phase, the scanning signal is at the first level, the first controlling signal and the second controlling signal are at the second level, and the data signal is supplied to the driving sub-circuit; and during the light emitting phase, the scanning signal is at the second level, and the first controlling signal and the second controlling signal are at the first level; and wherein the first level is a level for turning on the first to fourth transistors, and the second level is a level for turning off the first to fourth transistors.

For another example, during the pre-light emitting phase, the scanning signal and the second controlling signal are at the first level and the first controlling signal is at the second level, the first level is a level for turning on the first to fourth transistors, and the second level is a level for turning off the first to fourth transistors.

According to another aspect of the present disclosure, there is provided a display panel comprising: the pixel driving circuit in accordance with the embodiments of the present disclosure; a scanning signal line, configured to supply the scanning signal; a data signal line, configured to supply the reference voltage signal and the data signal; and a light emitting element, wherein the light emitting element has the first electrode coupled to the driving sub-circuit and the second electrode coupled to a second power voltage.

According to another aspect of the present disclosure, there is provided a display device, comprising the display panel in accordance with the embodiments of the present disclosure.

BRIEF DESCRIPTION OF THE DRAWINGS

Specific implementations of the embodiments of the present disclosure are further described in detail below with reference to the accompanying drawings, in which.

DETAILED DESCRIPTION

Figure 1:
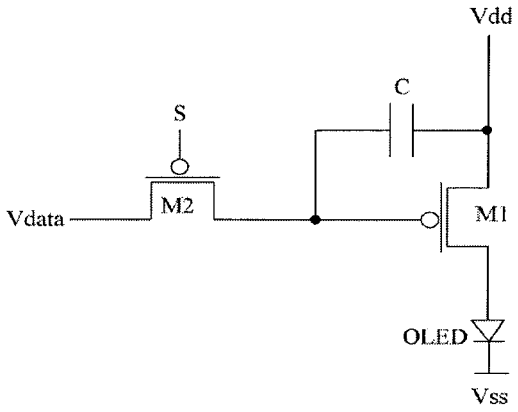
FIG. 1 shows a schematic structural diagram illustrating an OLED pixel driving circuit.

In order to illustrate the present disclosure more clearly, the present disclosure will be further described in detail below in combination with the preferred embodiments and drawings. In the following detailed description, various specific details are described to provide a comprehensive understanding of the embodiments of the present disclosure. However, those skilled in the art should understand that one or more embodiments can be implemented without those specific details. In other instances, well-known structures and devices are schematically shown in the drawings for simplification. It should be noted that the expression "comprising" does not exclude other elements or steps, and the expression "a" or "an" does not exclude a plurality.

Technical or scientific terms used in the description of the present disclosure may have ordinary meanings as understood by those skilled in the art, unless otherwise defined. The terms "first", "second" and similar expressions used in the embodiments of the present disclosure do not indicate or imply any order, quantity or importance, but are merely used to distinguish one component from others.

Furthermore, in the description of the embodiments of the present disclosure, the term "connected" or "coupled to" may mean that two components are directly connected together, or that two components are connected via one or more other components. In addition, the two components can be connected or coupled by wire or wirelessly.

Further, in the description of the embodiments of the present disclosure, the terms "first level" and "second level" are only used to distinguish two levels having different amplitudes. For example, the following description is made by taking "first level" as a low level and "second level" as a high level. Those skilled in the art will appreciate that the present disclosure is not limited thereto.

Each of transistors used in the embodiments of the present disclosure may be a thin film transistor or a field effect transistor or other devices having the same characteristics. Preferably, the thin film transistor used in the embodiment of the present disclosure may be an oxide semiconductor transistor. For a switching transistor used as a switching element, the source and the drain are symmetrical, so that the source and the drain are interchangeable. In the disclosed embodiment, one of the source and the drain is referred to as a first electrode, and the other one is referred to as a second electrode. In the following examples, a description will be given by taking the switching transistor being a P-type thin film transistor as an example. Those skilled in the art will appreciate that the embodiments of the present disclosure are obviously applicable to the case where the switching transistor is an N-type thin film transistor.

As shown in FIG. 1, a pixel driving circuit may include an OLED element, a driving transistor M1, a switching transistor M2, and a capacitor C. The capacitor C has one electrode coupled to a power supply voltage Vdd and a source of the driving transistor M1, and the other electrode coupled to a drain of the switching transistor M2 and a gate of the driving transistor M1, and configured to store a threshold voltage of the driving transistor M1. The switching transistor M2 has a gate coupled to a scanning line S, a source coupled to a data voltage Vdata, and a drain coupled to the gate of the driving transistor M1. The turning on/off of the switching transistor M2 is controlled by the scanning line S, which further controls inputting of the data voltage Vdata. The driving transistor M1 has the source coupled to the power supply voltage Vdd, a drain coupled to an anode of the OLED element, and a cathode of the OLED element is coupled to a reference voltage Vss. The data voltage Vdata is supplied to the gate of the driving transistor M1 through the switching transistor M2, so as to control the turning on/off of the driving transistor M1 and the amplitude of a current, thereby controlling the light emitting and brightness of the OLED element. The current flowing through the OLED when the OLED emits light $I_{OLED}$ is a current corresponding to the gate-source voltage Vgs of the driving transistor M1, and the current $I_{OLED}$ can be given by:

$$I_{OLED}=k(Vgs-Vth)^2=k(Vdd-V\text{data}-|Vth|)^2,$$

where k is a constant.

As can be seen from the above equation, in the above OLED pixel driving circuit, the current $I_{OLED}$ depends on the threshold voltage Vth of the driving transistor M1 and the power supply voltage Vdd. Inevitably, a drift of threshold voltage of the transistor and a voltage drop of the back plate will cause an uneven brightness of the OLED element.

Due to characteristics of a higher mobility and a more stable performance, low temperature polysilicon thin film transistors (LTPS TFT) are often used in display panels such as AMOLED, so as to construct a pixel circuit, thereby providing currents for the light emitting elements. However, due to limitations of a crystallization process, the LTPS TFT fabricated on a large-area glass substrate often has non-uniformities in electrical parameters such as threshold voltage and mobility. This non-uniformity will cause a divergence in the term of the current and the brightness of OLED display devices, which may be perceived by the human eye, i.e., a mura phenomenon. In addition, in the large-size display applications, since the power supplying line of the back plate has a certain resistance, and the driving current for all of the pixels is provided by ELVDD, the voltage in the areas of the back plate near the ELVDD power supplying position is higher than the voltage in the areas far from the ELVDD power supplying position. This phenomenon is referred as IR Drop. Since the voltage of ELVDD is related to the current, IR Drop will cause a divergence in currents of different areas, affecting the display effect.

Figure 2A:
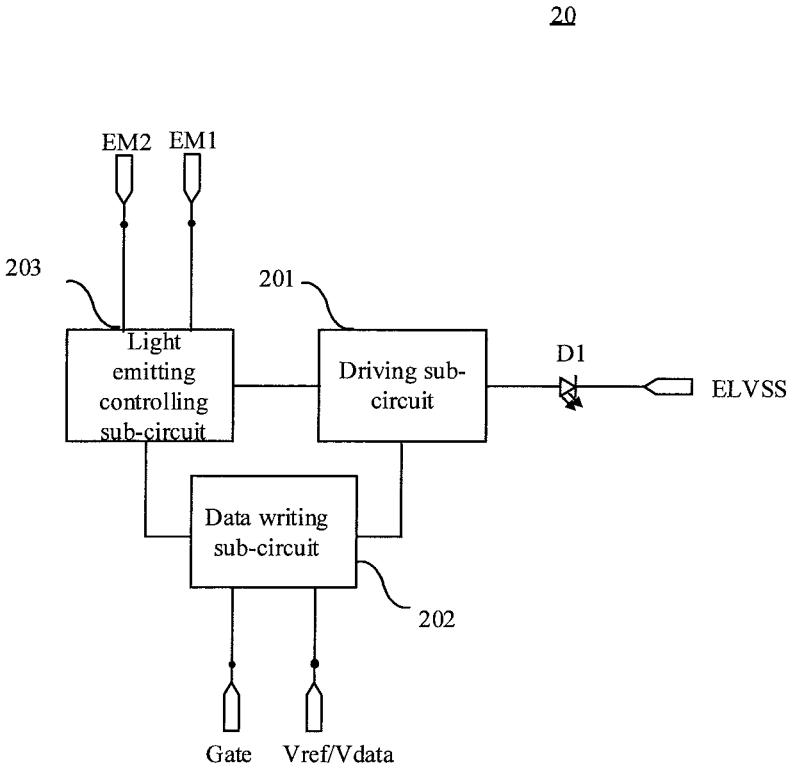
FIG. 2A shows a schematic structural diagram illustrating an example of a pixel driving circuit according to embodiments of the present disclosure.

FIG. 2A shows a schematic structural diagram illustrating an example of a pixel driving circuit according to embodiments of the present disclosure. As shown in FIG. 2A, the pixel driving circuit 20 according to the embodiment of the present disclosure may include a driving sub-circuit 201, coupled to the light emitting element D1; a data writing sub-circuit 202, coupled to the driving sub-circuit 201 and configured to receive a scanning signal Gate, a reference voltage signal Vref, and a data signal Vdata, and to supply the reference voltage signal Vref and the data signal Vdata to the driving sub-circuit 201 successively under a control of the scanning signal Gate; and a light emitting controlling sub-circuit 203, coupled to the data writing sub-circuit 202 and the driving sub-circuit 201, and configured to receive a first controlling signal EM1 and a second controlling signal EM2, and to control the driving sub-circuit 201 to drive the light emitting element D1 to emit light under a control of the first controlling signal EM1 and the second controlling signal EM2.

Figure 2B:
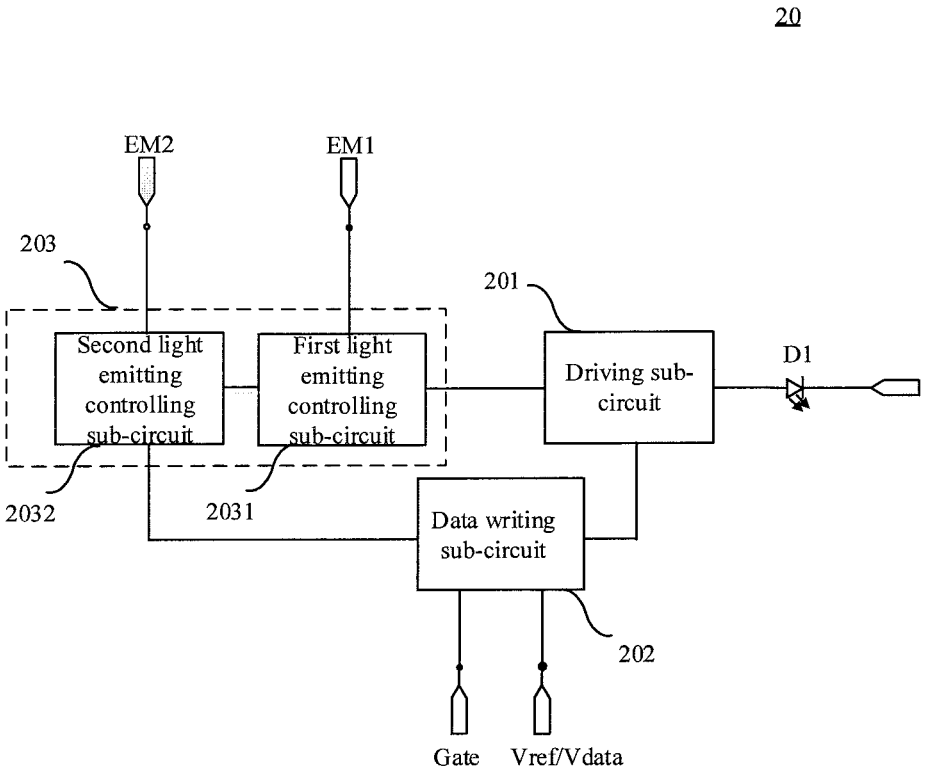
FIG. 2B shows a schematic structural diagram illustrating another example of the pixel driving circuit according to the embodiments of the present disclosure.

FIG. 2B shows a schematic structural diagram illustrating another example of the pixel driving circuit 20 according to the embodiments of the present disclosure. As shown in FIG. 2B, the light emitting controlling sub-circuit 203 may comprise a first light emitting controlling sub-circuit 2031 and a second light emitting controlling sub-circuit 2032. The first light emitting controlling sub-circuit 2031 is coupled to the driving sub-circuit 201, the second light emitting controlling sub-circuit 2032, and the second light emitting controlling sub-circuit 2032 is coupled to the driving sub-circuit 201.

Figure 2C:
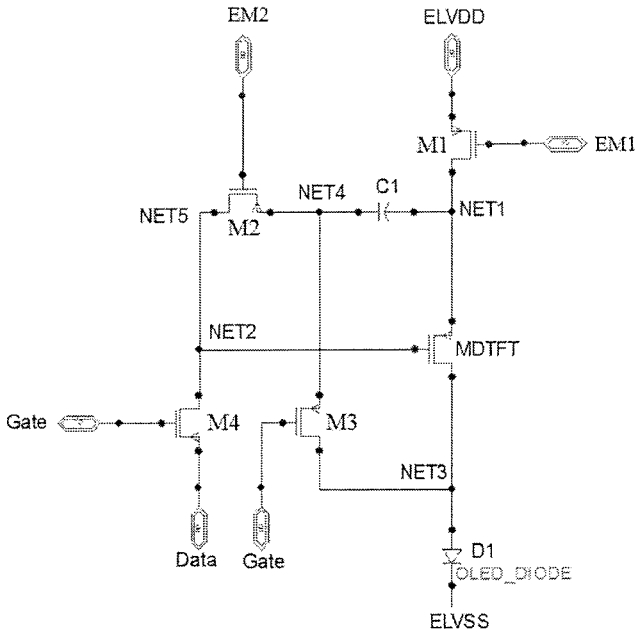
FIG. 2C shows a circuit diagram illustrating the pixel driving circuit according to the embodiments of the present disclosure.

FIG. 2C shows a circuit diagram illustrating the pixel driving circuit 20 according to the embodiments of the present disclosure. As shown in FIG. 2C, the first light emitting controlling sub-circuit 2031 may comprise a first transistor M1, the second light emitting controlling sub-circuit 2032 may comprise a second transistor M2, and the driving sub-circuit 201 may comprise a driving transistor MDTFT. The first transistor M1 has a controlling electrode to receive the first controlling signal EM1, a first electrode to receive a first power supply signal ELVDD, and a second electrode coupled to a drain of the driving transistor MDTFT. The second transistor M2 has a controlling electrode to receive the second controlling signal EM2, a first electrode coupled to the first light emitting controlling sub-circuit 2031, and a second electrode coupled to a gate of the driving transistor MDTFT; and the driving transistor MDTFT has a source coupled to a first electrode of the light emitting element D1.

The data writing sub-circuit 202 may comprise a third transistor M3, a fourth transistor M4, and a storage capacitor C1. The third transistor M3 has a controlling electrode coupled to the scanning signal Gate, a first electrode coupled to a first electrode of the storage capacitor C1 and the first electrode of the second transistor M2, and a second electrode coupled to the source of the driving transistor MDTFT. The fourth transistor M4 has a controlling electrode coupled to the scanning signal Gate, a first electrode coupled to the data signal Vdata, and a second electrode coupled to the gate of the driving transistor MDTFT. The storage capacitor C1 has a second electrode coupled to the drain of the driving transistor MDTFT.

For example, the drain of the driving transistor MDTFT is coupled to the anode of D1, so as to drive D1 to emit light, and the cathode of D1 is coupled to a second power signal ELVSS.

In the present embodiment, the description is made by taking the first transistor to the fourth transistor being P-type thin film transistors as an example. It should be understood that if an N-type thin film transistor is selected, the direction of the current flowing in the light emitting element of the pixel driving circuit and the levels of the power supply signals change as the thin film transistors with different conductivity types being used as the switching elements of the circuit. When the P-type thin film transistor is selected in the embodiment, the first power supply signal ELVDD is a high level signal, and the second power supply signal ELVSS is a low level signal.

In this embodiment, each thin film transistor is a low temperature polysilicon transistor, which may reduce manufacturing cost and power consumption and may have a fast electron mobility and a small footprint, improving the display resolution and stability.

In this embodiment, the turning on/off of the first and second transistors are controlled by the first and second controlling signals respectively, such that the circuit structure will change as the levels of the driving switching signal change. At the same time, the scanning signal Gate controls the writing process of the reference voltage signal Vref and the data signal Vdata. The data signal Vdata and the threshold voltage Vth of the driving transistor MDTFT are written to the first electrode of the storage capacitor C1, and the threshold voltage Voled_o of the OLED element is written to the second electrode of the storage capacitor, completing the writing of the voltage across the storage capacitor C1. This enable that the light emitting current of the OLED element $I_{OLED}$ is only related to the OLED threshold voltage Vth and the data signal Vdata, thereby alleviating the uneven brightness of the OLED element caused by the drift of threshold voltage Vth of the driving transistor and a voltage drop of the power supply signal ELVDD of the back plate.

Figure 3A:
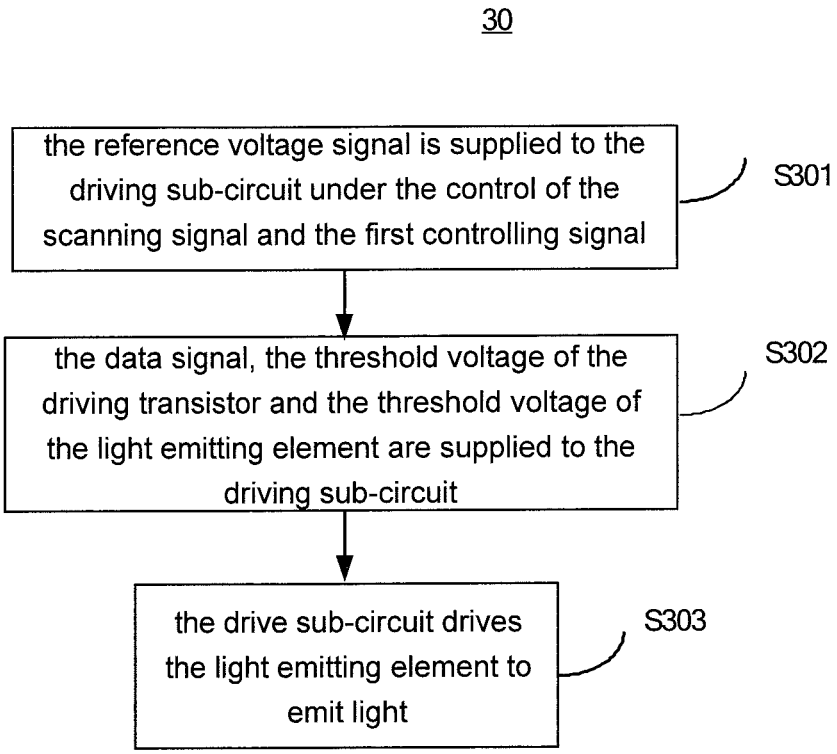
FIG. 3A shows a flow chart of a method for driving the pixel driving circuit according to the embodiments of the present disclosure.

FIG. 3A shows a flow chart of a method for driving the pixel driving circuit according to the embodiments of the present disclosure. As shown in FIG. 3A, the method for driving the pixel driving circuit in accordance with the embodiments of the present disclosure may comprise following steps.

In step S301, the reference voltage signal is supplied to the driving sub-circuit under the control of the scanning signal and the first controlling signal, during an initialization phase.

In step S302, the data signal, the threshold voltage of the driving transistor and the threshold voltage of the light emitting element are supplied to the driving sub-circuit, under the control of the scanning signal, during a compensation phase.

In step S303, the drive sub-circuit drives the light emitting element to emit light under the control of the first controlling signal and the second controlling signal, during a light emitting phase.

Figure 3B:
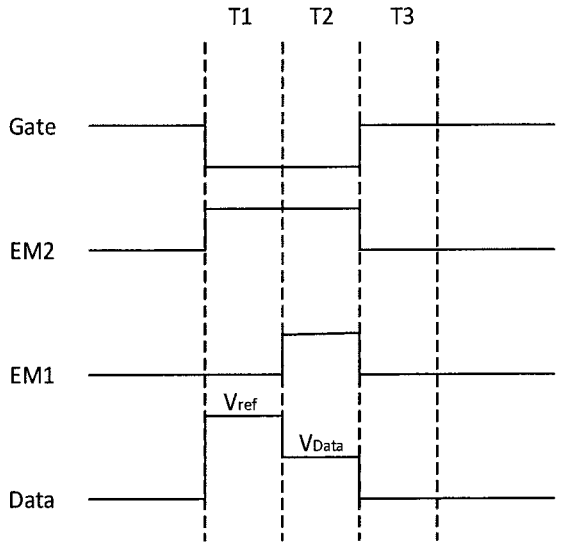
FIG. 3B shows a signal timing diagram of the pixel driving circuit according to the embodiments of the present disclosure.

FIG. 3B shows a signal timing diagram of the pixel driving circuit according to the embodiments of the present disclosure. The process and principle of the method for driving the above pixel driving circuit will be described below with reference to FIGS. 2C, 3A, and 3B. In the following description, a OLED is taken as an example of the light emitting element D1. It will be understood by those skilled in the art that the light emitting element D1 can also be any other light emitting element that is driven by current.

Since the P-type thin film transistor is used in the embodiment, when the signal at the gate of the transistor is a low level signal, the transistor is turned on; and when the signal at the gate of the transistor is a high level signal, the transistor is turned off. It should be noted that when transistor with a different conductivity type is selected, the levels of controlling signals are changed accordingly.

During the initialization phase T1, the first transistor M1, the third transistor M3, and the fourth transistor M4 are turned on due to the first controlling signal EM1, the second controlling signal EM2, and the scanning signal Gate. At the same time, the second transistor M2 is turned off, and the driving transistor MDTFT is turned off due to the data signal Vref. Thus, a fixed voltage offset is formed between the gate and source of the driving transistor MDTFT.

Figure 4:
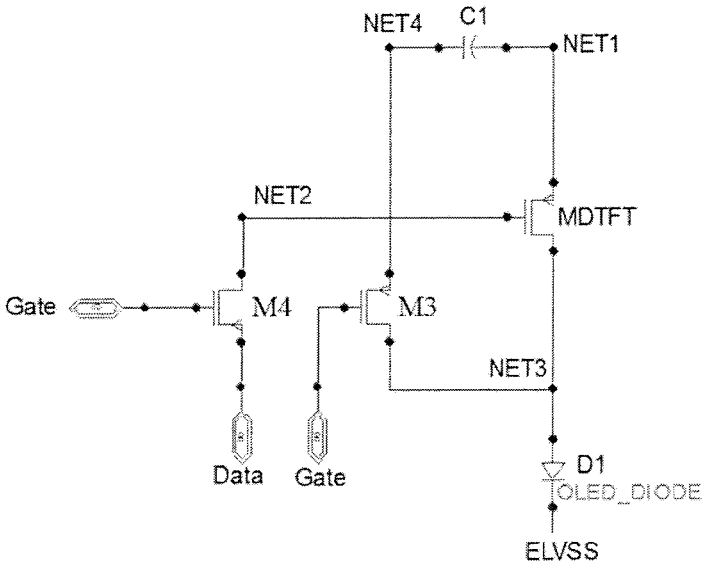
FIG. 4 shows an equivalent circuit diagram of the pixel driving circuit during an initialization phase according to the embodiments of the present disclosure.

In the initialization phase T1, the scanning signal Gate is at a low level, turning on the third transistor M3 and the fourth transistor M4. The first controlling signal EM1 is at a low level, turning on the first transistor M1. The second controlling signal EM2 is at a high level, turning off the second transistor M2. The reference voltage signal Vref is at a high level, turning off the driving transistor MDTFT. The equivalent circuit during the initialization phase is shown in FIG. 4.

During this phase, the voltage at the first node Vnet1 is the voltage of the first power supply signal, that is, Vnet1=ELVDD; the voltage at the second node Vnet2 is the voltage of the reference voltage signal, that is, Vnet2=Vref. The gate-source voltage of the driving transistor MDTFT is Vgs, wherein Vgs=Vref−ELVDD.

In order to ensure the off state of the driving transistor MDTFT, the gate-source voltage Vgs of the driving transistor MDTFT is set to be larger than its threshold voltage Vth, that is, Vref−ELVDD>Vth. It can be seen that the turning-off of the driving transistor MDTFT can be achieved by setting Vref>ELVDD+Vth.

Due to the hysteresis effect of the driving transistor and different driving currents being generated when a white picture is switched to a gray scale picture or when a black picture is switched to the gray scale picture, a difference in luminance between the sub-pixels may be generated, which may result in a short-term afterimage. It can be seen from the above analysis that a fixed voltage offset is formed between the gate and the source of the driving transistor MDTFT during the initialization phase, thereby improving the defect of the short-term afterimage and optimizing the display effect.

During the compensation phase T2, due to the first controlling signal EM1, the second controlling signal EM2, and the scanning signal Gate, the third transistor M3 and the fourth transistor M4 are turned on and the first transistor M1 and the second transistor M2, so as to write the data signal Vdata and the threshold voltage Vth of the driving transistor to the first electrode of the storage capacitor C1, and to write the threshold voltage Voled_o of the OLED to the second electrode of the storage capacitor C1.

Figure 5:
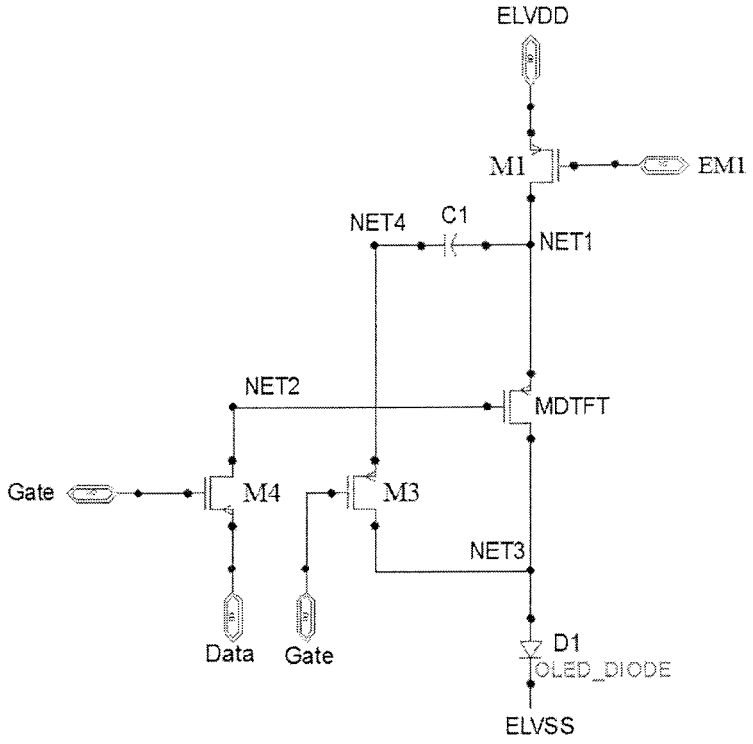
FIG. 5 shows an equivalent circuit diagram of the pixel driving circuit during a compensation phase according to the embodiments of the present disclosure.

During the compensation phase T2, the scanning signal Gate is at a low level, turning on the third transistor M3 and the fourth transistor M4. The first controlling signal EM1 is at a high level, turning off the first transistor M1. The second controlling signal EM2 is at a high level, turning off the second driving transistor M2. The driving transistor MDTFT is turned on by the data signal Vdata. The equivalent circuit during the compensation phase is shown in FIG. 5.

During this phase, the driving transistor MDTFT is turned on, and the voltage at the gate is the data signal voltage Vdata, and the voltage at the source is gradually decreased to Vdata−Vth. That is, the voltage at the first node Vnet1 is dropped from ELVDD to Vdata−Vth. The voltage at the second node voltage Vnet2=Vdata. Since Vgs>Vth, the driving transistor MDTFT is turned off. At this time, the current flowing through the driving transistor MDTFT is gradually decreased to zero. The third node voltage Vnet3=Voled_o, wherein Voled_o is the threshold voltage of the OLED. The fourth node voltage Vnet4=Vnet3=Voled_o.

When the compensation phase is expired, the voltage across the storage capacitor C1 is: Vnet1=Vdata−Vth, Vnet4=Voled_o, and the voltage difference $V_{C1}$ between the upper and lower plates of the storage capacitor C1 is:

$$V_{C1}=V\text{net1}-V\text{net4}=V\text{data}-Vth-V\text{oled_}o.$$

During the light emitting phase T3, due to the first controlling signal EM1, the second controlling signal EM2, and the scanning signal Gate, the first transistor M1 and the second transistor M2 are turned on and the third transistor M3 and the fourth transistor M4 are turned off, so as to turn on the driving transistor by the voltage signal stored in the storage capacitor C1, enabling the first power signal ELVDD to drive the OLED to emit light.

Figure 6:
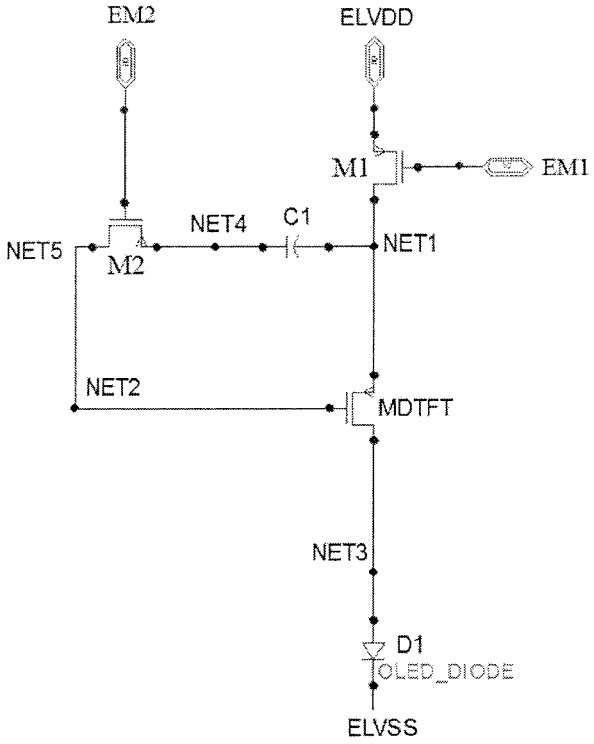
FIG. 6 shows an equivalent circuit diagram of the pixel driving circuit during a light emitting phase according to the embodiments of the present disclosure.

During the light emitting phase T3, the scanning signal Gate is at a high level, turning off the third transistor M3 and the fourth transistor M4. The first controlling signal EM1 is at a low level, turning on the first transistor M1. The second controlling signal EM2 is at a low level, turning on the second driving transistor M2. The storage capacitor C1 is connected in parallel between the gate and the source of the driving transistor MDTFT. The equivalent circuit during the light emitting phase is shown in FIG. 6.

During this phase, the voltage at the first node voltage Vnet1 is abruptly changed from Vdata−Vth to ELVDD. Since there is a voltage difference $V_{C1}$ between the upper and lower plates of the storage capacitor C1 during the phase T2, it is possible for the voltage at the fourth node Vnet4 to jump to ELVDD−VC1 during the phase T3. That is, $$V\text{net4}=\text{ELVDD}-V_{C1}=\text{ELVDD}-V\text{data}+Vth+V\text{oled_}o.$$

At this time, the light emitting current of the OLED $I_{OLED}$ is:

$$\begin{aligned} I_{OLED} &= k(Vgs-Vth)^2 \\ &= k(Vnet4-Vnet1-Vth)^2 \\ &= k(ELVDD-Vdata+Vth+\text{Voled_o}-ELVDD-Vth)^2 \\ &= k(\text{Voled_o}-Vdata)^2 \end{aligned}$$

wherein k is a coefficient.

It can be seen from the above equation that the light emitting current of the OLED $I_{OLED}$ is only related to the threshold voltage Vth of the OLED and the data signal Data. Thus, it is possible to solve the defect of uneven brightness of the OLED caused by the drift of threshold voltage Vth of the driving transistor and a voltage drop of the power supply signal ELVDD of the back plate.

Figure 7:
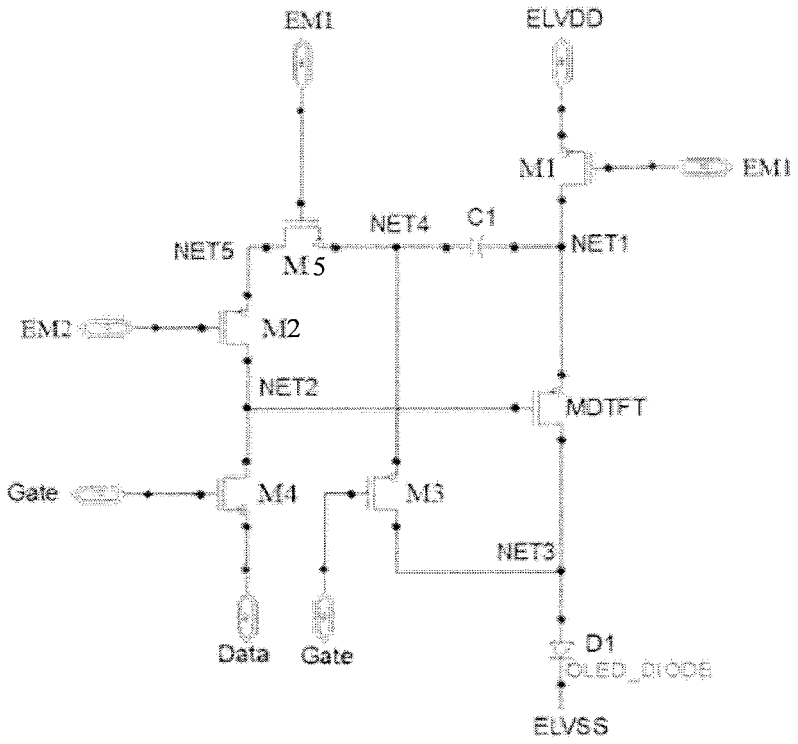
FIG. 7 shows a circuit diagram of another example of the pixel driving circuit according to the embodiments of the present disclosure.

FIG. 7 shows a circuit diagram of another example of the pixel driving circuit according to the embodiments of the present disclosure. As shown in FIG. 7, the first light emitting sub-circuit may further comprise a fifth transistor M5. The fifth transistor M5 has a controlling electrode coupled to the first controlling signal EM1, a first electrode coupled to the first electrode of the second transistor M2 and a second electrode coupled to the source of the driving transistor.

The difference between this embodiment and the embodiment shown in FIG. 2C is that there is a fifth transistor M5. Accordingly, the turning on/off of the first transistor M1 and the fifth transistor M5 are controlled by the first controlling signal EM1. In this embodiment, the selection of the transistor is the same as that of the above embodiment, and details are not described herein again.

In this embodiment, the turning on/off of the above switching elements is controlled by different controlling signals, so as to achieve the compensation function of the pixel driving circuit, and to enable that the light emitting current of the OLED is only related to the threshold voltage of the OLED and the data signal with no independence on the threshold voltage of the driving transistor and the voltage drop of the power supply voltage of the back plate. This can alleviate the uneven brightness of the OLED element caused by the drift of threshold voltage Vth of the driving transistor and a voltage drop of the power supply signal ELVDD of the back plate. Further, in the above controlling signals, the first controlling signal EM1 differ from the second controlling signal EM2 by one timing cycle, that is, the second controlling signal EM2 can be obtained by shifting the first controlling signal EM1, which reduces the number of controlling signals and reduces the complexity of the circuit.

Figure 8:
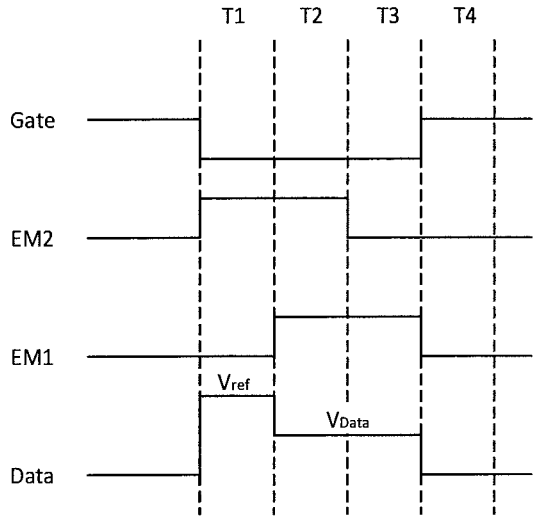
FIG. 8 shows a signal timing diagram of the other example of the pixel driving circuit according to the embodiments of the present disclosure.

The process and principle of the method for driving the above pixel driving circuit will be described below in conjunction with specific phases. FIG. 8 shows a signal timing diagram of the signals in the circuit.

During the initialization phase T1, the scanning signal Gate is at a low level, turning on the third transistor M3 and the fourth transistor M4. The first controlling signal EM1 is at a low level, turning on the first transistor M1 and the fifth transistor M5. The second controlling signal EM2 is at a high level, turning off the second transistor M2. The reference voltage signal Vref is at a high level, turning off the driving transistor MDTFT. The equivalent circuit during the initialization phase is shown in FIG. 4.

During this phase, a fixed voltage offset is formed between the gate and the source of the driving transistor MDTFT, thereby improving the defect of the short-term afterimage. The process and principle are similar with the example shown in FIG. 2C, and details are not described herein again.

During the compensation phase T2, the scanning signal Gate is at a low level, turning on the third transistor M3 and the fourth transistor M4. The first controlling signal EM1 is at a high level, turning off the first transistor M1 and the fifth transistor M5. The second controlling signal EM2 is at a high level, turning off the second transistor M2. The driving transistor MDTFT is turned on by the data signal Vdata. The equivalent circuit during the compensation phase is shown in FIG. 5.

During this phase, the voltage difference between the upper and lower plates of the storage capacitor C1 is obtained as $V_{C1}$, and the analysis process is the same as the example in FIG. 2C.

Unlike the example in FIG. 2C, there is a pre-light emitting phase T3. During this phase, the second controlling signal EM2 is at a low level. At this time, although the fifth transistor M5 is turned on under the control of the second controlling signal EM2, the equivalent circuit during this phase is not changed, since the second transistor M2 is still in the off state.

By using a signal that differs from the first controlling signal by one timing cycle and can be obtained by shifting the first controlling signal as the second controlling signal, the number of the controlling signals is reduced, thereby reducing the complexity of the circuit.

Further, in the present embodiment, the compensation phase T2 and the pre-light emitting phase T3 are both used for writing data signals, thereby prolonging the writing time and achieving a better writing effect.

Figure 9:
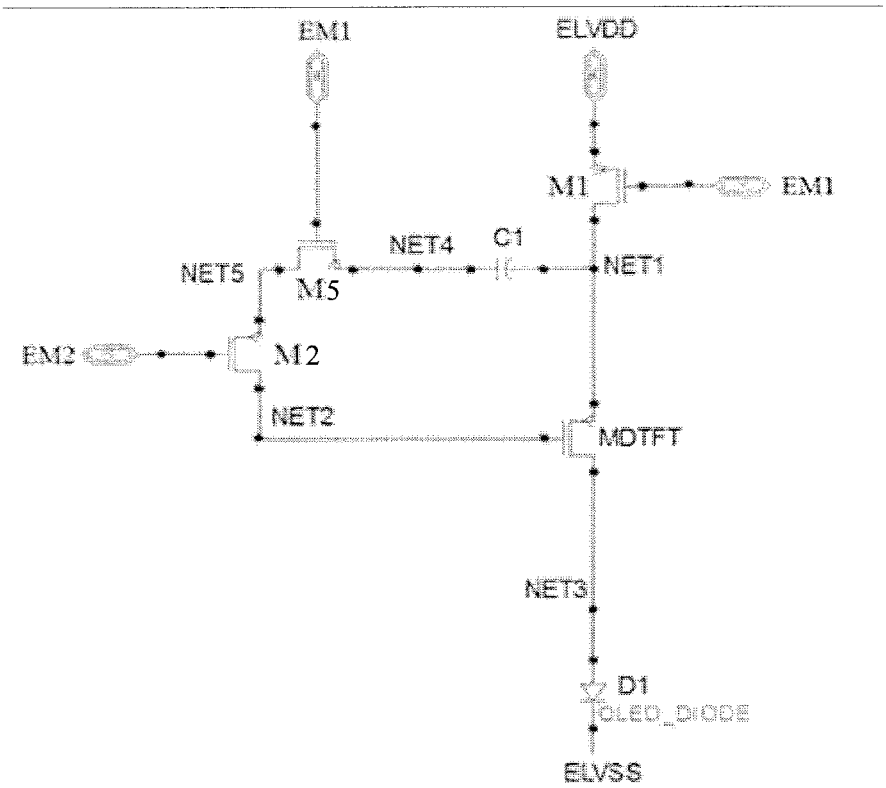
FIG. 9 shows an equivalent circuit diagram of the other example of the pixel driving circuit during a pre-light emitting phase according to the embodiments of the present disclosure.

During the light emitting phase T4, the scanning signal Gate is at a high level, turning off the third transistor M3 and the fourth transistor M4. The first controlling signal EM1 is at a low level, turning on the first transistor M1 and the second transistor M2. The second controlling signal EM2 is at a low level, turning on the fifth transistor M5. The data signal Vdata is at a low level, and the storage capacitor C1 is connected in parallel between the gate and the source of the driving transistor MDTFT. The equivalent circuit during the light emitting phase is shown in FIG. 9.

In this embodiment, the light emitting current $I_{OLED}$ of the OLED is $I_{OLED}=k(Vgs-Vth)^2$, and the calculation process of which is the same as that of the first embodiment. Thus, the details are not described herein again. It can be seen that the light emitting current $I_{OLED}$ of the OLED is only related to the threshold voltage Vth of the OLED and the data signal Data, thereby alleviating the uneven brightness of the OLED element caused by the drift of threshold voltage Vth of the driving transistor and a voltage drop of the power supply signal ELVDD of the back plate.

Figure 10:
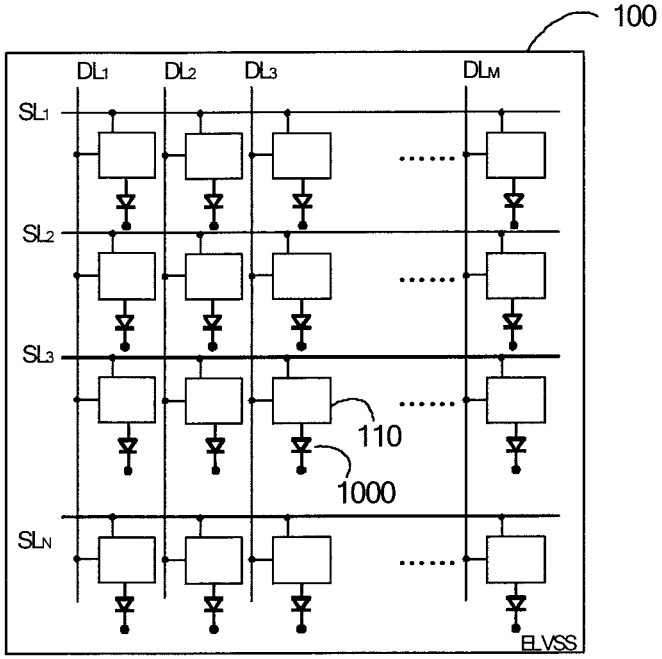
FIG. 10 shows a schematic diagram illustrating a display panel according to the embodiments of the present disclosure.

According to the embodiments of the present disclosure, there is provided a display panel. FIG. 10 shows a schematic diagram illustrating the display panel according to the embodiments of the present disclosure. As shown in FIG. 10, the display panel 100 may include the pixel driving circuit 110 in accordance with the embodiments of the present disclosure; a scanning signal line SL1~SLN, configured to supply the scanning signal; a data signal line DL1~DLM, configured to supply the reference voltage signal and the data signal; and a light emitting element 1000. The pixel driving circuit 110 in accordance with the embodiments of the present disclosure is coupled to the scanning signal line SL1~SLN and the data signal line DL1~DLM. The light emitting element 1000 has the first electrode coupled to the driving sub-circuit 110 and the second electrode coupled to the second power voltage ELVSS.

Figure 11:
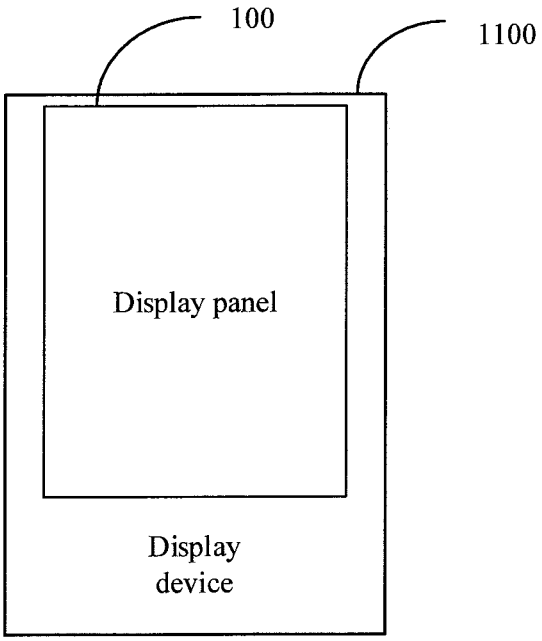
FIG. 11 shows a schematic diagram illustrating a display device according to the embodiments of the present disclosure.

According to the embodiments of the present disclosure, there is provided a display device comprising the display panel in accordance with the embodiments of the present disclosure. FIG. 11 shows a schematic diagram illustrating the display device 100 according to the embodiments of the present disclosure. As shown in FIG. 11, the display device 1100 according to the embodiment of the present disclosure may include a display panel 100 in accordance with above embodiment of the present disclosure. The display device can be any product or component having a display function, such as a mobile phone, a tablet, a television, a display, a laptop, a digital frame, a navigator, and the like.

It is apparent that the above-described embodiments of the present disclosure are merely examples for clearly illustrating the present disclosure, and are not intended to limit the implementations of the present disclosure. It will be apparent to those skilled in the art that various modifications and changes can be made in the present disclosure without departing from the spirit and scope of the disclosure. Thus, the present invention is intended to cover the modifications and the changes.

I claim:

1. A pixel driving circuit, configured to drive a light emitting element to emit light, the pixel driving circuit comprising:

a driving sub-circuit, coupled to the light emitting element;

a data writing sub-circuit, coupled to the driving sub-circuit and configured to receive a scanning signal, a reference voltage signal, and a data signal, and supply the reference voltage signal and the data signal to the driving sub-circuit successively under a control of the scanning signal; and a light emitting controlling sub-circuit, coupled to the data writing sub-circuit and the driving sub-circuit, and configured to receive a first controlling signal and a second controlling signal, and to control the driving sub-circuit to drive the light emitting element to emit light under a control of the first controlling signal and the second controlling signal;

wherein the light emitting controlling sub-circuit comprises a first light emitting controlling sub-circuit and a second light emitting controlling sub-circuit, wherein the first light emitting controlling sub-circuit comprises a first transistor, the second light emitting controlling sub-circuit comprises a second transistor, and the driving sub-circuit comprises a driving transistor, wherein the first transistor has a controlling electrode to receive the first controlling signal, a first electrode to receive a first power supply signal, and a second electrode coupled to a drain of the driving transistor; the second transistor has a controlling electrode to receive the second controlling signal, a first electrode coupled to the first light emitting controlling sub-circuit, and a second electrode coupled to a gate of the driving transistor; and the driving transistor has a source coupled to a first electrode of the light emitting element;

wherein the data writing sub-circuit comprises a third transistor, a fourth transistor, and a storage capacitor, wherein:

the third transistor has a controlling electrode to receive the scanning signal, a first electrode coupled to a first electrode of the storage capacitor and the first electrode of the second transistor, and a second electrode coupled to the source of the driving transistor; the storage capacitor has a second electrode coupled to the drain of the driving transistor; and the fourth transistor has a controlling electrode to receive the scanning signal, a first electrode to receive the reference voltage signal and the data signal successively, and a second electrode coupled to the gate of the driving transistor;

wherein the first light emitting sub-circuit further comprises a fifth transistor, wherein:

the fifth transistor has a controlling electrode configured to receive the first controlling signal and a first electrode coupled to the first electrode of the second transistor.

2. The pixel driving circuit of claim 1, wherein the driving transistor and the first to fourth transistors are low temperature polysilicon transistors.

3. The pixel driving circuit of claim 1, wherein the first to fourth transistors are P-type transistors.

4. The pixel driving circuit of claim 1, wherein the first to fourth transistors are N-type transistors.

5. A method for driving a pixel driving circuit, the pixel driving circuit comprising: a driving sub-circuit, coupled to a light emitting element; a data writing sub-circuit, coupled to the driving sub-circuit and configured to receive a scanning signal, a reference voltage signal, and a data signal, and supply the reference voltage signal and the data signal to the driving sub-circuit successively under a control of the scanning signal; and a light emitting controlling sub-circuit, coupled to the data writing sub-circuit and the driving sub-circuit, and configured to receive a first controlling signal and a second controlling signal, and to control the driving sub-circuit to drive the light emitting element to emit light under a control of the first controlling signal and the second controlling signal, the method comprising:

supplying the reference voltage signal to the driving sub-circuit under the control of the scanning signal and the first controlling signal, during an initialization phase;

supplying the data signal, a threshold voltage of the driving transistor and a threshold voltage of the light emitting element to the driving sub-circuit, under the control of the scanning signal, during a compensation phase; and driving, by the drive sub-circuit, the light emitting element to emit light under the control of the first controlling signal and the second controlling signal, during a light emitting phase.

6. The method of claim 5, further comprising:

supplying the data signal, the threshold voltage of the driving transistor, and the threshold voltage of the light emitting element to the driving sub-circuit under the control of the scanning signal and the second controlling signal, during a pre-light emitting phase prior to the light emitting phase but after the compensation phase.

7. The method of claim 5, wherein the reference voltage signal has an amplitude greater than that of the data signal.

8. The method of claim 5, wherein during the initialization phase, the scanning signal and the first controlling signal are at a first level, the second controlling signal is at a second level, and the reference voltage signal is supplied to the driving sub-circuit; wherein:

during the compensation phase, the scanning signal is at the first level, the first controlling signal and the second controlling signal are at the second level, and the data signal is supplied to the driving sub-circuit; and during the light emitting phase, the scanning signal is at the second level, and the first controlling signal and the second controlling signal are at the first level; and wherein the first level is a level for turning on the first to fourth transistors, and the second level is a level for turning off the first to fourth transistors.

9. The method of claim 6, wherein during the pre-light emitting phase, the scanning signal and the second controlling signal are at the first level, and the first controlling signal is at the second level, wherein the first level is a level for turning on the first to fourth transistors, and the second level is a level for turning off the first to fourth transistors.

10. The method of claim 8, wherein during the pre-light emitting phase, the scanning signal and the second controlling signal are at the first level and the first controlling signal is at the second level.

11. A display panel comprising:

the pixel driving circuit of claim 1;

a scanning signal line, configured to supply the scanning signal;

a data signal line, configured to supply the reference voltage signal and the data signal; and a light emitting element, wherein the light emitting element has the first electrode coupled to the driving sub-circuit and the second electrode coupled to a second power voltage.

12. A display device, comprising the display panel of claim 11.

* * * * *